US006272863B1

(12) United States Patent
Pfefferle et al.

(10) Patent No.: US 6,272,863 B1
(45) Date of Patent: Aug. 14, 2001

(54) PREMIXED COMBUSTION METHOD BACKGROUND OF THE INVENTION

(75) Inventors: William C. Pfefferle; Theodore R Strickland, both of Madison, CT (US)

(73) Assignee: Precision Combustion, Inc., New Haven, CT (US)

( * ) Notice: Subject to any disclaimer, the term of this patent is extended or adjusted under 35 U.S.C. 154(b) by 0 days.

(21) Appl. No.: 09/025,220

(22) Filed: Feb. 18, 1998

(51) Int. Cl.[7] ..... F23R 3/40
(52) U.S. Cl. ..... 60/723
(58) Field of Search ..... 60/39.06, 39.37, 60/39.826, 723

(56) References Cited

U.S. PATENT DOCUMENTS 3,928,961 * 12/1975 Pfefferle ..... 60/723
4,432,207 * 2/1984 Davis et al. ..... 60/723
5,460,002 * 10/1995 Correa ..... 60/723
5,473,882 * 12/1995 Zarzalis et al. ..... 60/737

* cited by examiner

*Primary Examiner*—Louis J. Casaregola
(74) *Attorney, Agent, or Firm*—Dreier & Baritz LLP

(57) ABSTRACT

This invention pertains to an apparatus and means to lower emissions of carbon monoxide and nitrogen oxides in lean, pre-mixed gas turbine combustors. Specifically, this invention employs a catalyst deposited on the inner surfaces of the combustor in the region of combustion which oxidizes CO combustion products. Also provided is a means for depositing a catalyst within the thermal barrier coating on the combustor liner walls.

12 Claims, 2 Drawing Sheets

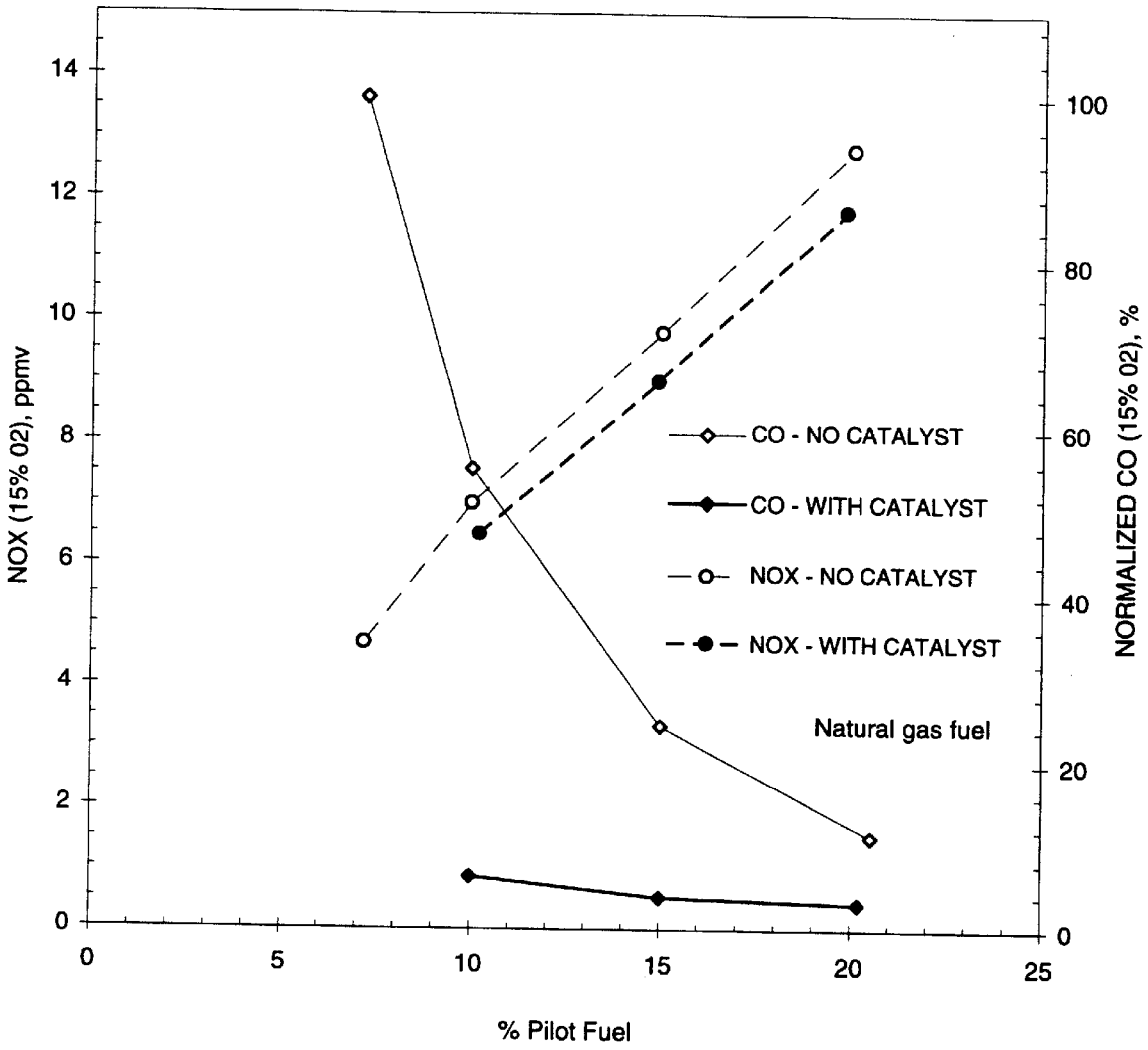
Figure 2. Lean Pre-mixed Gas Turbine Combustor Rig Test Results

PREMIXED COMBUSTION METHOD BACKGROUND OF THE INVENTION

BACKGROUND OF THE INVENTION

1. Field of Invention

This invention pertains to a means to lower emissions of carbon monoxide and nitrogen oxides in lean, pre-mixed gas turbine combustors. Specifically, this invention employs a catalyst deposited on the inner surfaces of the combustor in the region of combustion.

2. Brief Description of the Related Art

The lean, pre-mixed combustor, also known in the art as a dry low $NO_x$ combustor is a combustor in which fuel is premixed with air prior to combustion to form a largely homogeneous fuel lean admixture having an adiabatic flame temperature less than about 3100° F. (1700° C.). This differs from a diffusion flame combustor where the fuel is injected directly into the combustion zone and mixed with air during combustion. As a result, combustion is essentially at the stoichiometric fuel air ratio with combustion flame front temperatures as high as 4000° F. (2200° C.). Unlike diffusion flame combustors, lean, pre-mixed combustors avoid stoichiometric combustion and are able to inherently achieve lower $NO_x$ emission levels. In both approaches the combustion products are modified by dilution air to achieve the desired turbine inlet temperature, however lower amounts are required in the premixed system.

To achieve single digit $NO_x$ emission levels in a lean, pre-mixed combustor requires operating at a flame temperature of the fuel and air admixture no higher than approximately 2900° F. (or about 1600° C.). Unfortunately, as the flame temperature of a fuel and air admixture is decreased to approximately 2800° F. (or little more than 1500° C.), typically combustion becomes unstable and high carbon monoxide emissions are generated. Thus, legal compliance requirements placed on both $NO_x$ and carbon monoxide make the operating window for a lean, premixed combustor quite limited, even operating at rich enough conditions where $NO_x$ levels are as high as 15 or 20 ppmv.

Accordingly, various types of independently controlled pilots are employed in lean, pre-mixed combustors to extend the stable operating window below 2800° F. (1540° C.) to minimize $NO_x$ emissions. However, if the pilot is a flame some $NO_x$ is produced by it and often there is little or no corresponding improvement in overall carbon monoxide emissions. Thus, there is a very small operating window in which both $NO_x$ and carbon dioxide emissions meet environmental regulations.

The lean, pre-mixed combustor art is familiar with staging of combustion to achieve low emissions over a wide engine operating range where lower turbine inlet temperatures are required. Staging, however, has practical limits both in terms of its ultimate ability to reduce emissions as well as the level of complexity introduced into the design of the combustor system. Even with this complexity, most lean, premixed combustors cannot reliably achieve ever lower standards for carbon monoxide and $NO_x$ emissions, for example below 15 ppmv.

The art is also familiar with the use of catalysts to both improve combustion stability and reduce emissions in combustors. As demonstrated by U.S. Pat. No. 4,603,547, a catalyst was applied to the inner surface of a diffusion flame combustor for the purposes of flame stabilization. The patent teaches that in the event that the primary combustion zone is extinguished a re-ignition of the combustor can be achieved if the rich fuel-air mixture can contact a sufficiently hot catalytic surface. The catalytic surface must be non-continuous so that the flame created by the contact of the rich fuel and air mixture to it will leave the liner wall and ignite the bulk combustor flow. The discontinuity in the catalyst coating is identified in those regions where film cooling of the combustor would be non-existent, the surfaces prior to or directly over the film cooling air inlets.

As taught by U.S. Pat. No. 5,355,668, a catalyst applied to a diffusion flame combustor, such as that of U.S. Pat. No. 4,603,547 should also tend to reduce unburned hydrocarbons and carbon monoxide emissions. The invention, however, teaches that the combustor is completely film cooled, due to the temperature of combustion, and that the flame, or reactants, contact the catalytic surface.

The present invention allows achievement of both lower $NO_x$ emissions and lower carbon monoxide emissions in lean, pre-mixed combustors. These reductions are possible in a lean, premixed combustor both with and without open flame pilots. The invention also provides a means to operate at leaner conditions if carbon monoxide emissions are the limiting factor in the design, allowing lower firing temperatures and the associated incremental $NO_x$ reduction.

SUMMARY OF THE INVENTION

It has now been found that catalytic coatings applied to interior surfaces of lean, pre-mixed combustors can significantly reduce both carbon monoxide emissions, typically by more than fifty percent, and $No_x$ emissions, typically by more than five percent at a given lean operating condition with an equivalence ratio less than 0.65. In addition, in a lean, pre-mixed combustor utilizing a pilot flame, the catalytic coating will allow the pilot flame fuel flow to be reduced thereby reducing pilot flame $NO_x$ generation for a given combustor carbon monoxide emissions level and exit temperature.

In the present invention a catalyst is deposited on the inner surfaces of the combustor with particular attention to the areas of highest interaction with combustion gases, not the flame or reactants. For catalyst effectiveness, it is important that the catalyst be located within the combustion zone on the combustor wall in areas that are not blanketed by film cooling air. As the combustion zone and film cooling within the combustion zone are altered due to different operational conditions, it may be necessary to coat the entire combustor to assure that the catalyst at any given time is in an effective area. Backside cooled liner walls are preferred since such systems do not flow significant cool air on the flame tube side of the wall where the catalyst is applied.

While a lean, pre-mixed combustor that does not utilize film cooling is ideal for this invention, a total elimination of film cooling is not required. It is critical that if film cooling is employed, that the operational non-film cooled area, that is the area of the combustor not film cooled at an operational condition where $NO_x$ or carbon monoxide reduction is desired, be at least about 10% of the total with 40% to greater than 70% preferred.

In addition, it is critical to this invention that catalyst cooling, generally accomplished by backside cooling of the combustor wall onto which the catalyst is applied, be engineered such that the catalyst is maintained at an effective operating temperature. This temperature is at a minimum the threshold light-off temperature for the particular catalyst interacting with the particular fuel. Typical precious metal catalysts have minimum operating temperatures of approximately 400° C. Thus, with metal liners it is desirable to place the catalyst on a thermal barrier inner coating (TBC) which lines the inner surfaces of the flame tube or combustor liner. The catalyst can be applied directly to ceramic combustor liners if so equipped.

BRIEF DESCRIPTION OF THE DRAWINGS

FIG. 2 is a graph of test results comparing a pilot-flame-assisted, lean, pre-mixed combustor with and without a catalytic coating on the combustor at various levels of pilot fuel flow as a percentage of the total fuel flow.

DETAILED DESCRIPTION AND PREFERRED EMBODIMENT

Figure 1:
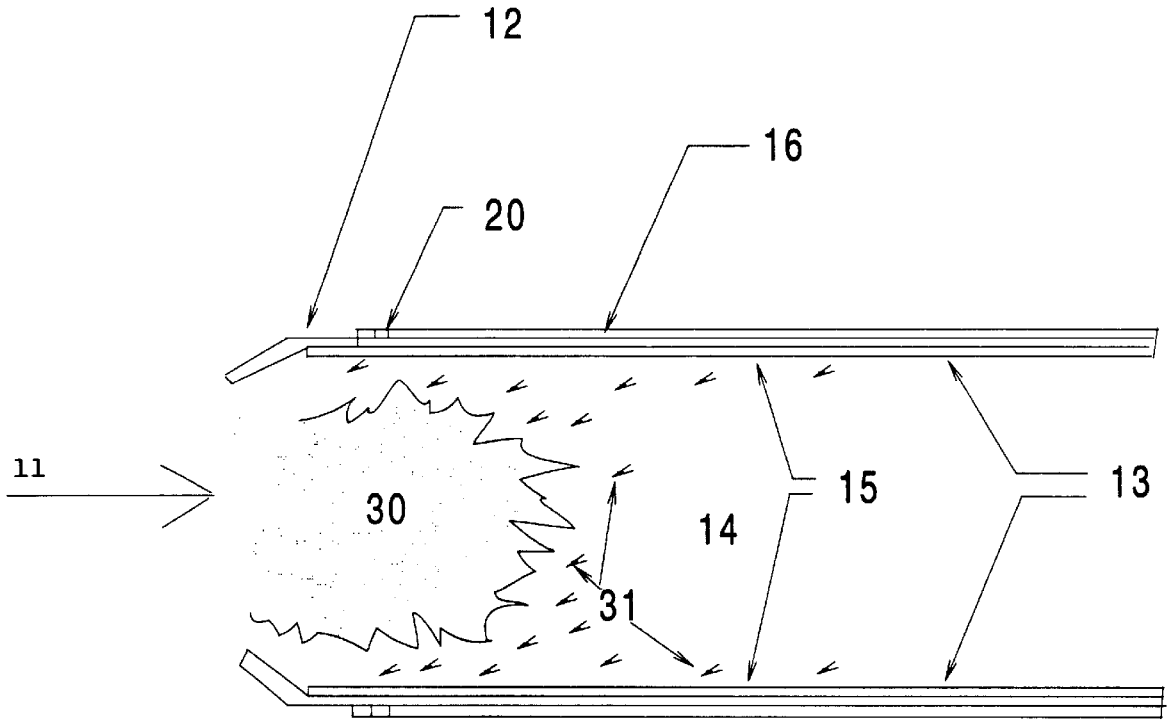
FIG. 1 shows a simplified schematic of a lean, pre-mixed combustor with ceramic walls or TBC coated metal walls onto which said catalyst is deposited therein.

A lean, premixed combustor with catalyst impregnated on the inner surfaces of the liner walls is shown in FIG. 1. Premixed fuel and air 11 enters the combustion chamber 12 where they are ignited to form flame 30 within the combustion zone 14. Products 31 are derived from flame 30. Catalyst 15, appropriate for the application, is applied to the combustor liner walls having ceramic interior surfaces 13. Such surfaces may comprise a ceramic based thermal barrier coating 17, applied to structural metal walls 16. If needed to limit wall temperatures, cooling air is added through optional film cooling or back-side cooling holes 20.

The preferred embodiment of the present invention is a follows. A lean premixed fuel 11 enters the combustion chamber 14 where it is ignited to form flame 30. The flame 30 generates reactants 31 which can contact catalyst 15 in the operational non-film cooled areas.

The ceramic internal surfaces of a combustion chamber was impregnated with catalyst to provide means to oxidize carbon monoxide and reduce $NO_x$ emissions. In the case of a metal liner structure, the catalyst was applied to the TBC surfaces which have been bonded to the interior of the metal liner structure. While the base metal of the combustor can be any metal currently used for combustors of this type, the suitable base metals are Hastalloy Alloy X (AMS 5536), Inconel 617 (AMS 5887 or 5889), or Inconel 718 (AMS 5596G or 5597C).

In the present invention, it is preferred that the metal combustion chamber interior surfaces be coated with yttria stabilized zirconia thermal barrier coating on top of a base coat. The base coat composition may be as follows; Co 10–40%, Cr 15–30%, Al 5–15%, Y 0.05–1% and the balance Ni. A suitable top coat composition is as follows; Y 5–10% and Zr 90–95%. The top coat porosity should be less than 20%, preferably 10%. The total thickness, base coat plus top coat, should be at least about 0.01 inches. The thermal barrier coating can be applied using typical flame spray techniques or other similar means known in the art.

The catalyst was impregnated into the thermal barrier coat by the following procedure. First, the thermal barrier coating was oxidized. In the preferred method, oxidation was accomplished by uniform heating of the combustor using a furnace (in all cases of furnace use which follow, if the furnace is electric, it is preferred to add a small bleed flow of air to purge fumes generated). The combustor was heated from room temperature to 700° C. at a rate of 10° C. per minute. The rate, however, could vary as the rate is selected to prevent significant stress between the thermal barrier coating and the base metal of the combustor. The temperature was held at 700° C. for one hour. The furnace is cooled at the same rate as for heating to room temperature before opening.

To create an aluminum oxide barrier within the TBC, an aluminum organo-metallic, in a preferred embodiment aluminum resinate (ENGLEHARD #83808), a mixture of aluminum organo-metallic and a solvent, was applied to the room temperature thermal barrier coating. The preferred embodiment used an aluminum resinate mixture comprising two-thirds aluminum resinate to one-third Toluene, by volume. Any method of application can be used, such as brushing, or spraying and the loading was approximately 0.06 ml/in$^2$. The aluminum resinate mixture in the coated areas was dried using forced hot air at a temperature of approximately 150° C. After completing the coating of the entire area, the combustor was calcined in a furnace by heating to 350° C. at a rate of 10° C./minute and held at 350° C. for 30 minutes. After 30 minutes the furnace was cooled to room temperature at the same rate as for heating.

The catalyst solution was then applied to the treated thermal barrier coating. Forced warm air was used to dry the mixture as it was being applied. The catalyst loading was 0.05 ml/in$^2$. After the entire surface was coated, the component was heated in air to 700° C. at a rate of 10° C. per minute and held for one hour to calcine the coating. The contents were then cooled to room temperature at the same rate used for heating. Alternate procedures known to those skilled in the art may also be used to achieve an active catalytic surface.

While the optimum catalyst composition is determined for the particular fuel burned in the combustor, in the preferred embodiment natural gas was the fuel. The catalyst used was as a percentage by weight; Al 2%, Zr 3%, Pt 76%, Pd 3%, Ce 12% and Rh 4%. It is preferred that the catalyst contain at least 0.1% of a group VIII metal, such as platinum.

EXAMPLE

To demonstrate the effectiveness of the catalytic walls in reducing carbon monoxide emissions in lean, pre-mixed combustors, a catalyst coating was applied to the thermal barrier coated walls of a lean, premixed gas turbine combustor burning natural gas used in a ground power application. The emissions performance of the coated liner was then compared to that of the standard liner without the catalyst coating. As shown in FIG. 2, in atmospheric pressure tests operating at $NO_x$ levels of 10 ppmv or lower (relatively lean fuel/air mixtures), carbon monoxide emissions were reduced by over seventy percent and $NO_x$ by about ten percent at the simulated base load condition. A test at elevated pressures confirmed the effectiveness of the combustor wall coatings in reducing emissions of carbon monoxide and $NO_x$.

What is claimed is:

1. A low emission gas turbine combustor operating at an operational temperature comprising:

an operational non-film cooled area greater than 10%, and a catalyst deposited within said operational non-film cooled area, the catalyst as deposited defining a light-off temperature, the light-off temperature being less than the operational temperature.

2. The combustor of claim 1 further comprising a thermal barrier coating, said thermal barrier coating deposited on the interior surface of said combustion chamber in the region of a combustion zone, said catalyst deposited therein.

3. The combustor of claim 1 further comprising a ceramic layer deposited on an interior surface of said combustion chamber, said catalyst deposited therein.

4. The combustor of claim 1 wherein said catalyst is a precious metal.

5. The combustor of claim 4 further comprising a gaseous fuel, said gaseous fuel comprised of natural gas.

6. The combustor of claim 5 wherein said gaseous fuel is methane.

7. The combustor of claim 1 wherein said operational non-film cooled area is greater than 70%.

8. The combustor of claim 7 further comprising a thermal barrier coating, said thermal barrier coating deposited on the interior surface of a combustion zone, said catalyst deposited therein.

9. The combustor of claim 7 comprising a ceramic liner wherein said catalyst is deposited thereon.

10. The combustor of claim 7 wherein said catalyst is a precious metal.

11. The combustor of claim 7 further comprising a gaseous fuel, said gaseous fuel comprised of methane.

12. The combustor of claim 11 wherein said gaseous fuel is methane.

* * * * *